US008141310B2

(12) United States Patent
Trezza

(10) Patent No.: US 8,141,310 B2
(45) Date of Patent: Mar. 27, 2012

(54) THIN BRICK AND TILE DRAINAGE SYSTEM

(76) Inventor: Ronald Trezza, Melville, NY (US)

( * ) Notice: Subject to any disclaimer, the term of this patent is extended or adjusted under 35 U.S.C. 154(b) by 498 days.

(21) Appl. No.: 11/983,448

(22) Filed: Nov. 9, 2007

(65) Prior Publication Data

US 2008/0229691 A1 Sep. 25, 2008

Related U.S. Application Data

(60) Provisional application No. 60/919,214, filed on Mar. 21, 2007.

(51) Int. Cl.
*E04B 1/70* (2006.01)
*E04F 17/00* (2006.01)

(52) U.S. Cl. ..... 52/302.3; 52/385; 52/747.1

(58) Field of Classification Search ..... 52/302.6, 52/385, 387, 384, 518, 526, 527, 749.11, 52/403.1, 389, 302.3, 661, 716.2, 747.12, 52/386

See application file for complete search history.

(56) References Cited

U.S. PATENT DOCUMENTS 764,989 A * 7/1904 Chester ..... 52/450
1,624,121 A * 4/1927 Thiem ..... 52/371
3,019,560 A 2/1962 Hansen
4,773,201 A 9/1988 Trezza
4,809,470 A 3/1989 Bauer
D306,907 S 3/1990 Trezza
5,228,937 A 7/1993 Passeno
5,311,714 A * 5/1994 Passeno ..... 52/314
5,551,204 A * 9/1996 Mayrand ..... 52/795.1
5,822,937 A * 10/1998 Mahony et al. ..... 52/366
6,151,854 A * 11/2000 Gutjahr ..... 52/385
6,516,577 B2 * 2/2003 Pelfrey et al. ..... 52/302.1
6,802,165 B1 10/2004 Passeno
6,941,707 B2 * 9/2005 Sigmund ..... 52/95
7,546,719 B1 * 6/2009 Guevara ..... 52/716.2
2002/0139060 A1 * 10/2002 Contreras et al. ..... 52/101
2003/0213212 A1 * 11/2003 Passeno ..... 52/745.19
2004/0065035 A1 * 4/2004 De Vlam ..... 52/384
2007/0062137 A1 * 3/2007 Maylon ..... 52/367

* cited by examiner

*Primary Examiner* — William Gilbert
*Assistant Examiner* — Theodore Adamos
(74) *Attorney, Agent, or Firm* — Harold G. Furlow, Esq.

(57) ABSTRACT

A sheet is provided for placing a brick or tile facing on a support structure that has an arrangement of apertures for the passage of fluids such as water. The sheet has an approximately rectangular conformation that includes a front and a back. The sheet defines channels between longitudinally aligned parallel partitions that are separated by a wall. Each channel receives the thin bricks or tiles. The structure of the partitions varies and can include an upward facing first portion that has an arrangement of apertures and a downward facing second portion. A liquid, such as water, that drains down the front of the sheet passes through the apertures in the first portion to the sloped second portion and is then redirected to the back of the sheet. The apertures also provide for the circulation of air. A method is provided for the drainage of liquid from the front of the sheet to the back of the sheet by providing a partition in the sheet that has at least one aperture that passes liquid from the front to the back of the sheet.

19 Claims, 6 Drawing Sheets

THIN BRICK AND TILE DRAINAGE SYSTEM

CROSS-REFERENCE TO RELATED APPLICATIONS

This application claims priority to provisional application 60/919, 214 filed Mar. 21, 2007, the disclosure of which is incorporated by reference herein and made a part of this application. The disclosure of U.S. Pat. No. 4,773,201 to Trezza is incorporated herein by reference and made a part of the disclosure of this patent application.

BACKGROUND OF THE INVENTION

1. Field of the Invention

The present invention relates to support panels for thin brick and tile and more specifically to support panels that assist in the drainage and aeration of thin brick and tile facades.

2. Description of the Related Art

The exterior sheathing of structures such as homes, apartments or commercial buildings are vulnerable to water intrusion and condensation that can damage the structure and endanger the health of the inhabitants. Thin brick and tile exterior sheathing systems provide a permanent attractive facade that has many advantages, but thin brick and tile like all other facades is still vulnerable to water intrusion. For example, over time moisture can penetrate around and through the thin brick or tile and into the grooves or low points of the supporting panels that hold the thin brick and tile in position. This moisture has the undesirable potential to break down the bonds between the materials and over a long period of time corrodes the supporting panels.

A far greater concern for moisture has developed, however, in the form of fungi. That concern is that structural elements such as support panels for thin brick and tile can retain or pool moisture and contribute to environmental conditions that can lead to the growth of harmful mildews and molds. While there are many different support panels in the marketplace, heretofore none of the support panels has addressed the need for a cohesive system that precludes pooling and drains water from the support panel.

A support panel is needed that has a structure for retaining thin brick and tile that precludes the pooling of water, advantageously drains water to the back of the support panel and provides aeration.

SUMMARY

A thin brick drainage system is described that comprises a sheet that has a front and an opposed back. The sheet has a first lateral side edge and a second lateral side edge as well as a top longitudinal edge and an opposed bottom longitudinal edge. The front defines a plurality of partitions that separate a plurality of longitudinally aligned channels. The partitions project outward from the front to define a support structure for the bricks. The channels are adapted to receive a row of bricks.

A first portion of the partition faces upward and projects forward from the front face. The first portion connects to a second portion of the partition that is downward facing and projects backward from the connection with the first portion at an angle inclined from the normal.

At least one aperture is defined in the first portions that is positioned in fixed spaced separation. The second portion is aligned for receiving drainage from the aperture and directing the drainage to the back of the sheet.

The sheet includes three channels that are defined by a first connector, a bottom partition and two partitions equally spaced between the bottom partition and the first connector. The first portions of the partitions are inclined downward. The plurality of sheets can be connected to a drainage panel to form an interconnected plurality of sheets and drainage panel assembly.

A structure for the support and drainage of a thin brick facade is described that comprises a sheet that has a front face and an opposed back. The sheet also includes a first lateral side edge and a second lateral side edge as well as a longitudinal top edge and a longitudinally bottom edge. The front defines at least one longitudinally aligned channel. The channel is defined by a pair of approximately parallel longitudinally aligned partitions. The pair of adjoining partitions is separated by a wall of the front face. The partitions project forward from the front face. The channels are adapted to receive and support thin bricks. At least one of the partitions includes one or more apertures and an inclined surface that redirects liquid from the front of the sheet to the back of the sheet.

The partition includes a first portion that is upward facing and projects forward from the front face. The three channels of the sheet are defined by four partitions. At least one of the partitions includes a second portion that connects to the first portion of the partition. The first portion of the at least one partition is upward facing and projects forward from the front face and inclines downward from the front face and define at least one aperture. The second portions are inclined downward from the connection with the first portion. An uppermost partition is a connector. The second portion of the at least one partition is a liquid impermeable barrier that directs the flow of liquid from the apertures in the first portion to the back of the sheet. The apertures defined in these three partitions extend at least partially onto the adjoining wall of the channel. The sheet is interconnected together with a drainage panel to form an integrated assembly.

A method for providing fluid flow through a structure that supports thin bricks comprising providing a sheet that has a front and a back. The front includes a plurality of longitudinally aligned partitions that extend outwardly from the front to define at least one longitudinally aligned channel. The channels are adapted for receiving and supporting bricks. At least one aperture is defined in the partitions for the passage of liquids from the front to the back of the sheet. The partitions also provide the function of receiving and redirecting the fluids passing through the at least one aperture between the front and the back of the sheet.

The further providing of a plurality of sheets connected to a drainage panel to define an assembly. The interconnected plurality of sheets and drainage panel assembly provides for the draining fluids from the front of the sheets to the back of the sheets and to the drainage panel. The sheet and drainage panel assembly can be connected to a support structure in a single step.

BRIEF DESCRIPTION OF THE DRAWINGS

Preferred embodiments of the invention are described below with reference to the drawings, wherein like numerals are used to refer to the same or similar elements.

DETAILED DESCRIPTION

Figure 1:
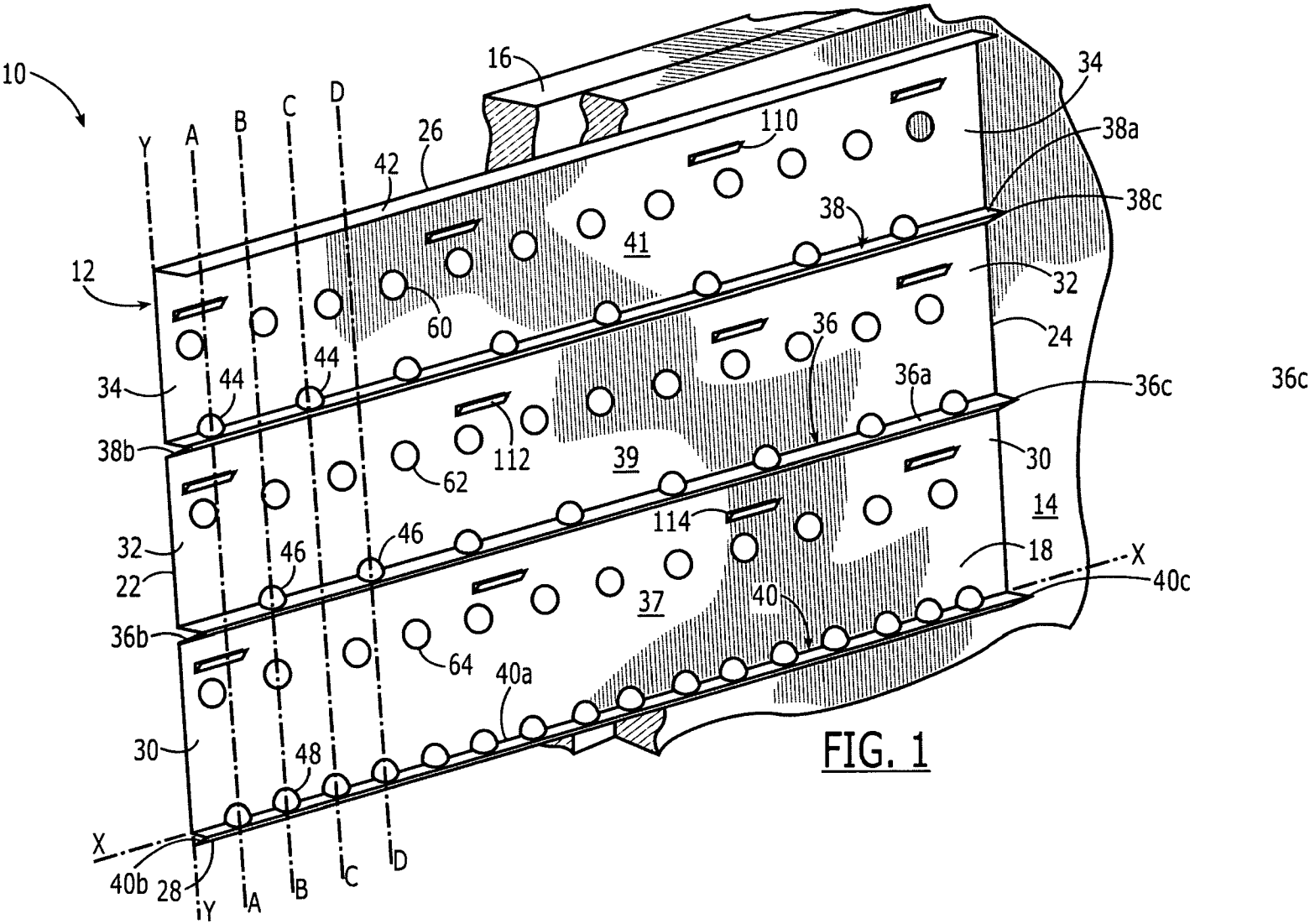
FIG. 1 is a front and side perspective view of a sheet of a thin brick and tile drainage system constructed in accordance with the present disclosure, the sheet is adapted to be connected to a drainage panel and/or a support structure.

Referring to FIG. 1, the brick and tile drainage system 10 includes one or more sheets 12 that preferably have a rectangular conformation. Sheets 12 are adapted for use with a drainage panel 14 and/or a support structure 16. Each sheet 12 has a face or front 18, a back 20 (see FIG. 2), a first lateral edge 22, an opposed second lateral edge 24, an upper edge 26, a lower edge 28. Upper edge 26 and lower edge 28 are aligned with a longitudinal axis-X. Lateral edges 22 and 24 are aligned with a lateral axis-Y that is perpendicular to longitudinal axis-X. It is understood that as described herein the axis-Y is a vertical axis and axis-X is a horizontal axis. It is also understood that the terms up, upward or the upward direction is defined as approximately vertical movement in the direction from lower edge 28 towards upper edge 26. Similarly, the terms down, downward or the downward direction is defined as approximately vertical movement in the direction from upper edge 26 towards lower edge 28.

Sheets 12 define a plurality of channels aligned with longitudinal axis-X that are sized and dimensioned for receiving thin brick or tile. For the purposes of this application it is understood that references to a thin brick encompasses thin brick and tile as well as any other equivalent alternative substitutes. In this preferred embodiment, there are three U-shaped channels: a first channel 30, a second channel 32 and a third channel 34. Channels 30, 32 and 34 are defined by a combination of partitions 36, 38, 40 and 42 and walls 37, 39 and 41.

Partitions 36, 38, 40 and 42 are longitudinally aligned cantilevered beams that extend outwardly or forwardly from front 18 in a direction that is approximately perpendicular to face 18. Walls 37, 39 and 41 are approximately aligned with front 18. Channel 30 is defined by partition 40, partition 36 and wall 37. Channel 32 is defined by partition 36, partition 38 and wall 39. Channel 34 is defined by partition 38, partition 42 and wall 41. In this one preferred embodiment, partitions 36 and 38 are positioned equidistantly between partition 40 and partition 42. Partition 40 includes lower edge 28 and partition 42 includes upper edge 28.

Figure 2:
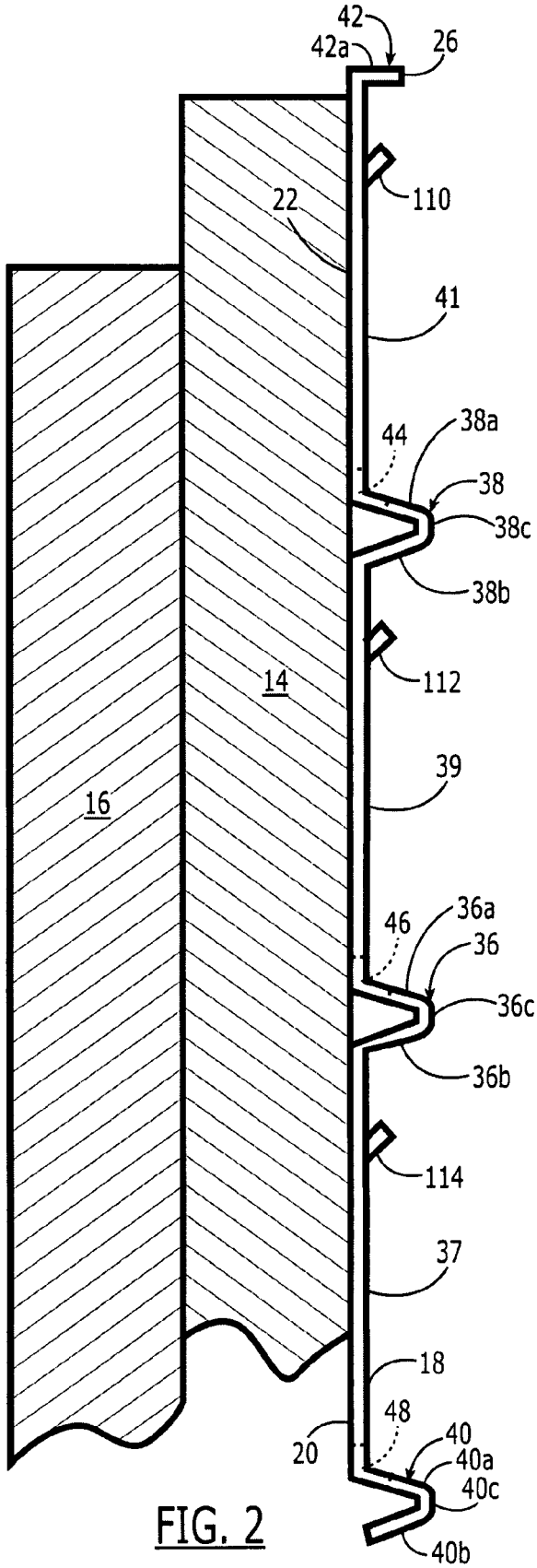
FIG. 2 is a side view of the sheet of FIG. 1 connected to the drainage panel and support structure.

As shown in FIGS. 1 and 2, the openings of the three U-shaped channels 30, 32 and 34 of sheet 12 are directed outward and approximately perpendicular to front 18. Similarly, front 18 and walls 37, 39 and 41 are aligned. Partition 38 is preferably a fold in sheet 12 that defines a V-shape protrusion from front 18 that includes an upward facing first portion 38*a* and a downward facing second portion 38*b* joined at a fold or an edge 38*c*. Portion 38*a* defines a ledge that preferably inclines downward from wall 41 to edge 38*c*. The angle of inclination of portion 38*a* from the perpendicular to wall 41 can vary and/or be arcuate, but preferably defines a slope from the horizontal for the downward flow of water. Portion 38*b* is inclined downward from edge 38*c* to wall 39. The angle of inclination of portion 38*b* from the perpendicular to wall 39 can vary and/or be arcuate, but defines a slope from the horizontal for the downward flow of water to back 20. The gap between portions 38*a* and 38*b* preferably increases from edge 38*c* to front 18 to define the approximate V-shape of partition 38.

Portion 38*a* is a support structure for the thin bricks and includes at least one drainage aperture 44 that is a through hole in sheet 12. At least one aperture 44 is preferably a plurality of apertures 44 that is arranged in a fixed spaced separation along portion 38*a*. In this preferred embodiment, apertures 44 are aligned with longitudinal axis-X and have an approximately ⅜ or 0.375 inch diameter rims spaced at two inch intervals between centerlines. The rims of apertures 44 on portion 38*a* preferably extend across and onto the adjoining wall 41. Apertures 44 are vertically aligned with portion 38*b*. In contrast to portion 38*a*, portion 38*b* is a wall that is impermeable to liquids.

Partition 36 preferably has the same structure as that of partition 38 and is a fold in sheet 12 that includes an upward facing first portion 36*a* and a downward facing second portion 36*b* joined at a fold or an edge 36*c*. Portion 36*a* defines a ledge that inclines from wall 39 to edge 36*c*. The angle of inclination of portion 36*a* from the perpendicular to wall 39 can vary and/or be arcuate, but preferably defines a slope from the horizontal for the downward flow of water. Portion 36*b* is inclined downward from edge 36*c* to wall 37. The angle of inclination of portion 36*b* from the perpendicular to wall 37 can vary and/or be arcuate, but defines a slope from the horizontal for the downward flow of water. The gap between portions 36*a* and 36*b* preferably increases from edge 36*c* to front 18 to define the approximate V-shape of partition 36.

Portion 36*a* is a support structure for thin brick and includes at least one drainage aperture 46 that is a through hole in sheet 12. At least one aperture 46 is preferably a plurality of apertures 46 that is arranged in a preset fixed spaced separation along portion 36*a*. In this preferred embodiment, apertures 46 are aligned with the longitudinal axis-X and have an approximately ⅜ or 0.375 inch diameter rims spaced at two inch intervals between centerlines. The rims of apertures 46 on portion 36*a* preferably extend across and onto the adjoining wall 39. In contrast to portion 36*a*, portion 36*b* is a wall that is impermeable to liquids.

Partition 40 preferably has the same approximate structure as that of partitions 36 and 38. Partition 40 includes an upward facing first portion 40*a* and a downward facing second portion 40*b* joined at a fold or an edge 40*c*. Portion 40*a* defines a ledge that inclines from wall 37 to edge 40*c*. The angle of inclination of portion 40*a* from the perpendicular to wall 37 can vary and/or be arcuate, but preferably defines a slope from the horizontal for the downward flow of water. Portion 40*b* is inclined downward from edge 40*c* to a terminal free end or lower edge 28 of sheet 12. The angle of inclination of portion 40*b* from the perpendicular can vary and/or be arcuate, but defines a slope from the horizontal for the downward flow of water. The gap between portions 40*a* and 40*b* preferably increases from edge 40*c* to front 18 to define the approximate V-shape of partition 40.

Portion 40*a* is a support structure for the thin bricks and includes at least one drainage aperture 48 that is a through hole in sheet 12. At least one aperture 48 is preferably a plurality of apertures 48 that is arranged in a fixed spaced separation along portion 40*a*. In this preferred embodiment, apertures 48 are aligned with the longitudinal axis-X and have an approximately ⅜ or 0.375 inch diameter rims spaced at one inch intervals between centerlines. The rims of apertures 48 preferably extend across and onto the adjoining wall 37. In contrast to portion 40*a*, portion 40*b* is a wall that is impermeable to liquids.

Apertures 44, 46 and 48 are arranged to collect water on sheet 12. In addition, apertures 44, 46 and 48 provide aeration for sheet 12. In this preferred embodiment, apertures 44 are aligned with vertical axes A and C and apertures 46 are aligned with vertical axes B and D. The respective vertical centerlines of apertures 46 are offset from the vertical centerlines of apertures 44 and not aligned relative to the axis-X. The centerlines of apertures 46 are positioned approximately at the midpoint between the two-inch intervals between the centerlines of apertures 44. Apertures 48 can be aligned with axes A, B, C and D or offset therefrom. The arrangement of apertures 44, 46 and 48 ensures a systematic and substantially continuous collection of water along partitions 38, 36 and 40 of front 18 and the passage of that water through sheet 12 to back 20. The vertical alignments of at least one apertures 44, 46 and 48 of partitions 38, 36 and 40, respectively, ensures the systematic collection of water by sheet 12.

Apertures 44, 46 and 48 are described herein as having circular rims and being linearly aligned at fixed intervals along partitions 36, 38 and 40. It is understood, however, that the rims of apertures 44, 46 and 48 can take any shape, such as for example polygons or slots that extend onto at least part of portions 36*a*, 38*a* and 40*a* and remain within the scope of the present disclosure. Similarly, the arrangement of apertures 44, 46 and 48 can vary in their intervals and alignments and remain within the scope of this disclosure.

Partition 42 can have the same approximate structure as that of partitions 36, 38 and 40 or alternatively have a structure that is a simple cantilevered beam that bounds the upper side of channel 34. The cantilevered beam of partition 42 has an upward facing side 42*a* and a downward facing side 42*b* and preferably inclines upward from wall 41 to upper edge 26 of sheet 12. Partition 42 is preferably a liquid impermeable partition, but partition 42 can also include one or more apertures. The angle of inclination of partition 42 from the perpendicular to wall 41 can vary and/or be arcuate, but preferably defines a slope from the horizontal for the downward flow of water. Partition 42 or first connector 42 also preferably functions to connect with other sheets 12.

Sheets 12 are connected together in an arrangement by positioning partition 42 in the gap between portions 40*a* and 40*b* of partition 40 of another sheet 12. Similarly, partition 40 receives a partition 42 from another sheet 12 such that sheets 12 can connect across a drainage panel 14 and/or support structure 16 of a wall.

Sheet 12 also includes a plurality of apertures or through holes 60 in channel 34, 62 in channel 32 and 64 in channel 30. In one preferred embodiment apertures 60, 62 and 64 are preferably covered with double-faced tape or adhesive as the bricks or tile are positioned on each ledge 36*a*, 38*a* and 40*a*. The adhesive locks the bricks or tile in place on sheet 12. Joint mortar is subsequently applied around the thin brick or tile. Mortar tie apertures 110, 112 and 114 are preferably formed as partial punches in walls 41, 39 and 37 respectively and are positioned at fixed spaced intervals facilitate the anchoring of the joint mortar and thin brick or tile in position in channels 34, 32 and 30.

The height and length dimensions of sheets 12 can vary depending upon the intended application of thin brick and tile system 10. Factors include the dimensions of drainage panel 14 and/or support structure 16. In one preferred embodiment sheets 12 range from approximately 16-24 inches in height and to 48 inches in length. It is understood that sheets 12 can be fabricated in dimensions to meet any particular construction need to include larger dimensions of 10 feet by 12 feet, for example. Sheets 12 are preferably made of corrosion resistant sheet metal, but sheets 12 can also be fabricated of other materials such as polymers or composites.

Figure 3:
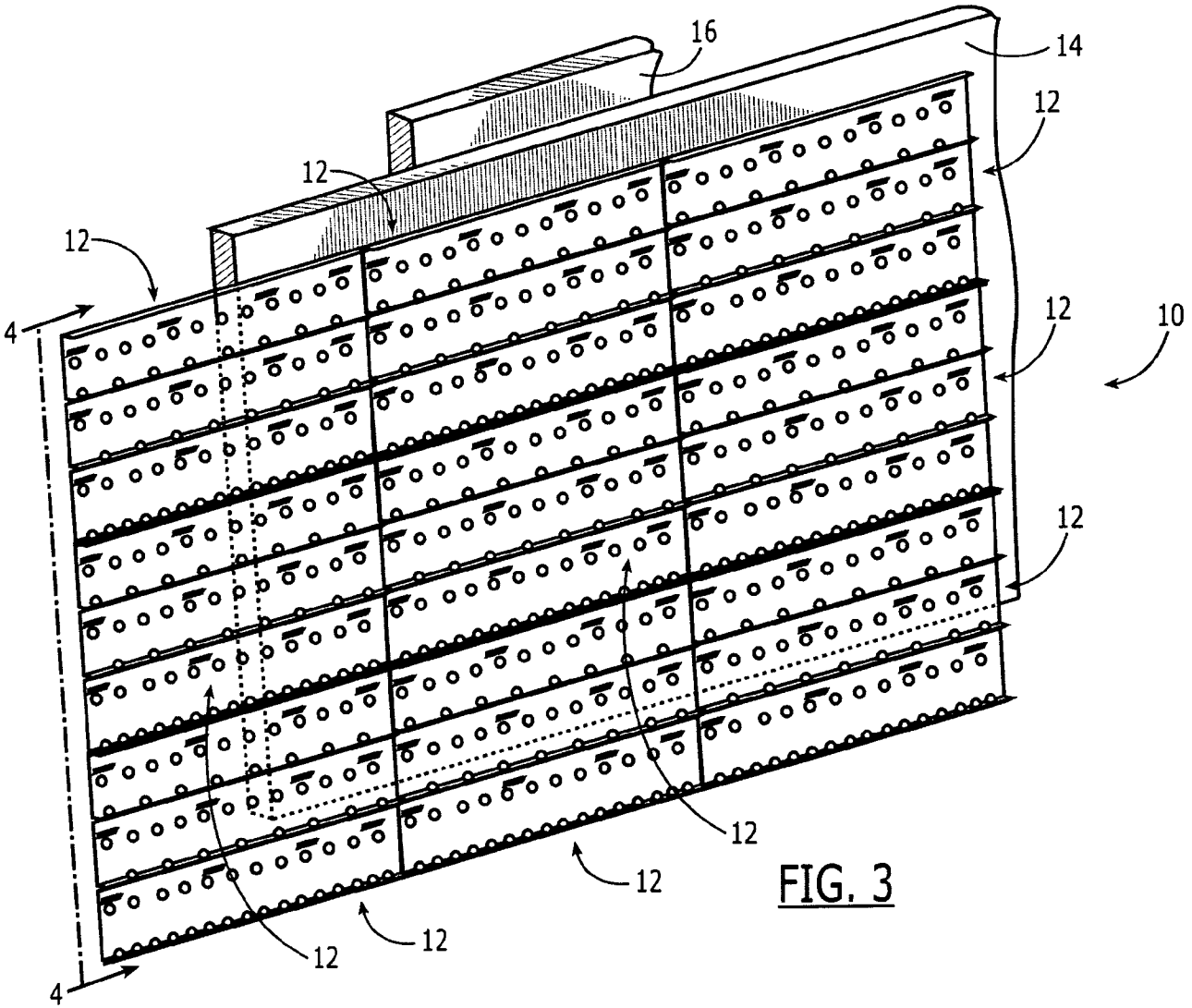
FIG. 3 is a front and side perspective view of a second embodiment of the thin brick and tile drainage system of FIG. 1 that is a preassembled interconnected plurality of sheets and drainage panel.
Figure 4:
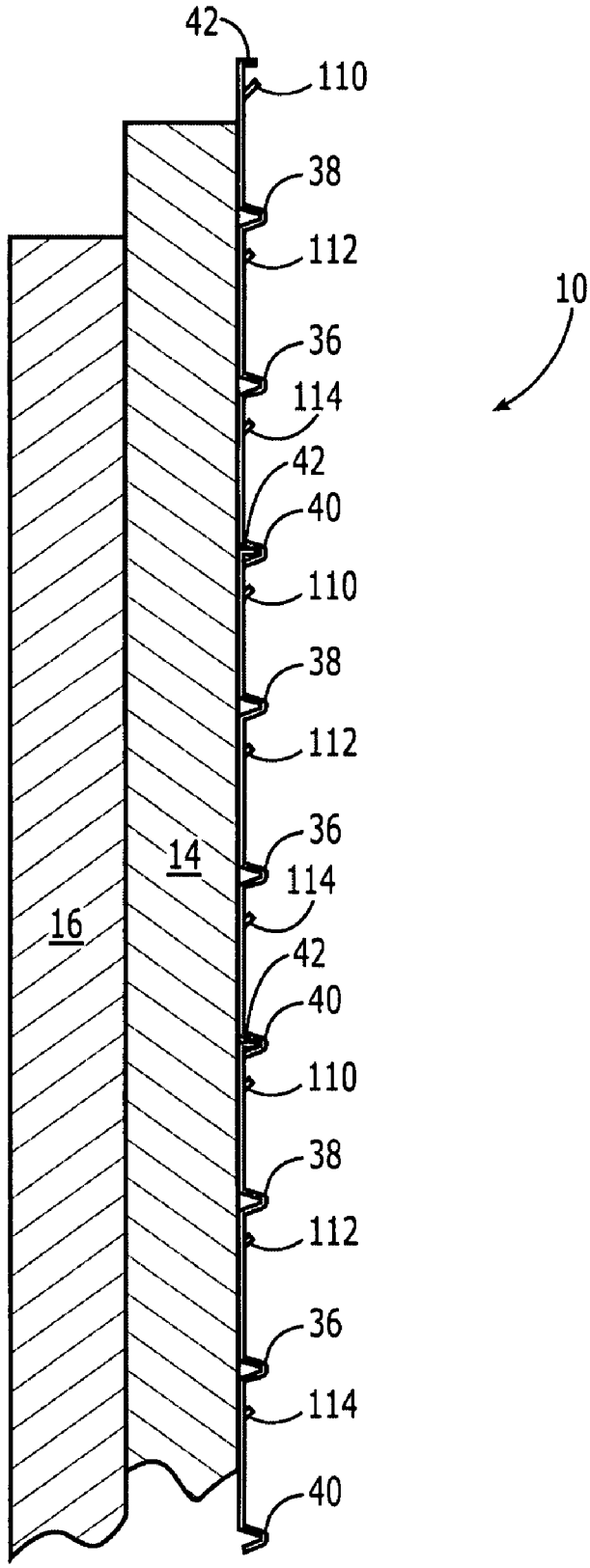
FIG. 4 is a side view of the interconnected plurality of sheets and drainage panel assembly of FIG. 3.
Figure 5A:
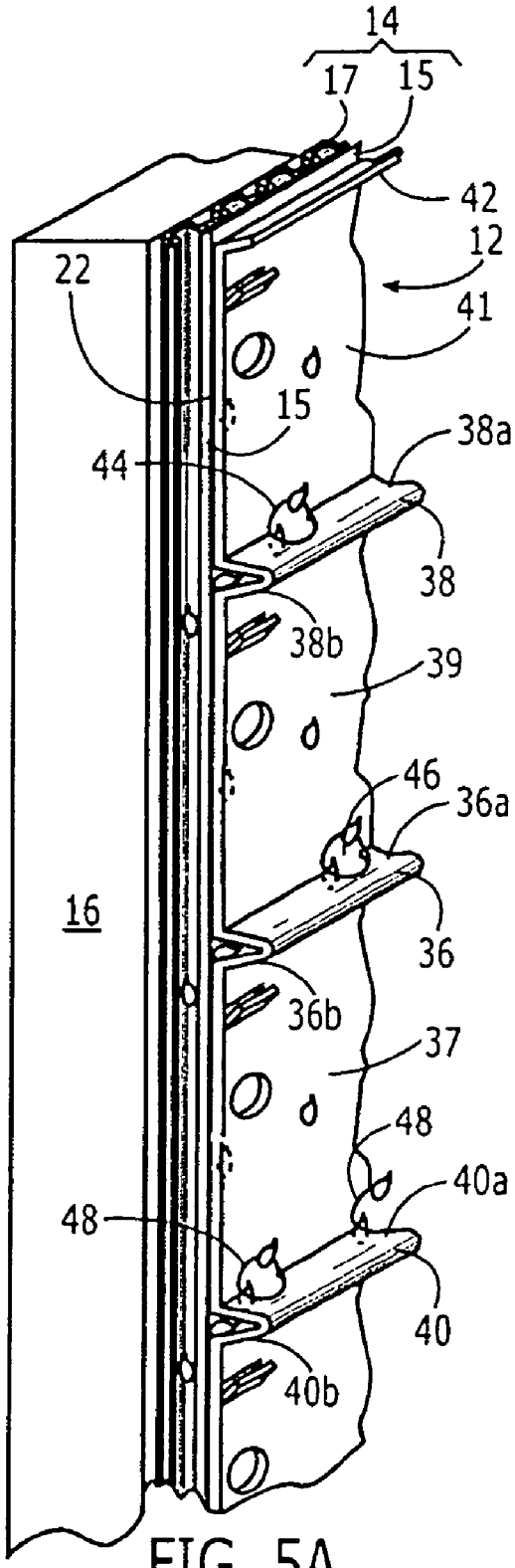
FIG. 5A is a partial perspective side and front view of one embodiment of the sheet of FIG. 1 showing the drainage of liquid through the thin brick and tile drainage system.
Figure 5B:
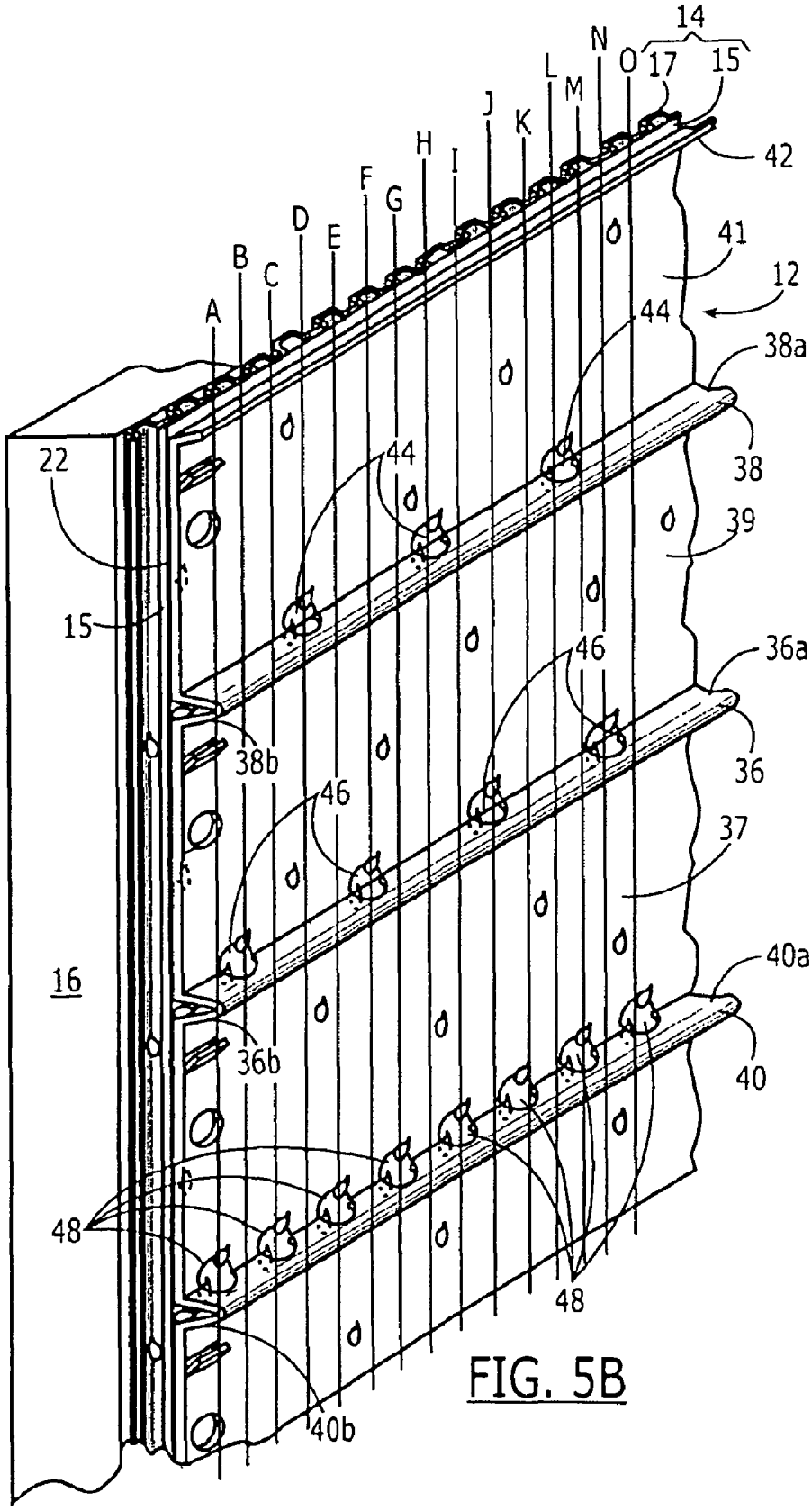
FIG. 5B is a partial perspective side and front view of one embodiment of the sheet of FIG. 1 showing the drainage of liquid through the thin brick and tile drainage system.

Referring now to FIGS. 3 and 4, thin brick and tile drainage system 10 in a second preferred embodiment includes a section of a drainage panel 14 and one or more sheets 12 that are integrated together as a single assembly. The integrated assembly of sheet 12 and drainage panel 14 is connected to support panel 16 in a single step. In this preferred embodiment, the sheets 12 and drainage panels 14 have dimensions in height and width that approximately correspond, but the perimeter of drainage panel 14 is offset from the perimeter of the sheet 12 such that a pre-determined portion of sheet 12 extends beyond the perimeter of drainage panel 14. The offset or overhang of sheet 12 relative to drainage panel 14 is preferably on both one of the longitudinal and one of the lateral sides of the interconnect assembly. The offset between the interconnected sheets 12 and panel 14 provides for a dispersion of joints between different assemblies of interconnected sheet 12 and panel 14. The offset between sheet 12 and drainage panel 14, if any, can vary dependent upon the particular application of drainage system 10.

Drainage panels 14 can come in a variety of different structures. In this one preferred embodiment, drainage panel 14 includes a flexible layer 15 and a flexible corrugated structure 17 that can bend and flex with sheet 12. Layer 15 functions include the filtering of undesirable particles from fluids passing through sheet 12 that can block the apertures or drainage channels of structure 17. Layer 15 and corrugated structure 17 provide a vertical pathway for the downward passage of water. The integrated assembly of sheet 12 and drainage panel 14 assembly has the back side 20 of sheet 12 abutting layer 15.

Sheet 12 preferably connects to drainage panel 14 using stainless steel staples that penetrate through sheet 12 and secure panel 14 to sheet 12 in a fixed relationship. Staples are preferably used at approximately 16 inch intervals along the longitudinal length of one or more of walls 37, 39 and 41 of channels 30, 32 and 34, respectively. Stainless steel staples advantageously provide a corrosion resistant reliable mechanical connection between sheet 12 and panel 14. Alternative fastening means can include adhesives, heat bonding and screws and other mechanical fasteners depending upon the materials of sheet 12 and panel 14. Corrugated structure 17 is on the side of panel 14 that is opposed to sheet 12 and is positioned directly onto support structure 16.

As shown in FIGS. 1 and 2, in operation thin brick and tile drainage system 10 can be bent around corners and at angles from approximately zero degrees to approximately 180 degrees and yet have sufficient rigidity to bridge undulations or imperfections in the support structure. Further, the continuous vented rolled ledges 36*a*, 38*a* and 40*a* spread the overall weight of the thin brick or tile evenly along partitions 36, 38 and 40. Channels 30, 32 and 34 of sheets 12 can be structured to accommodate all sizes of thin brick and tile. In addition, sheets 12 can be used on sloped surface and the angles of partitions 36, 38 and 40 adjusted to ensure that a proper incline is maintained.

Support structure 16 can be plywood, pressboard concrete block, brick or any other structure that is suited for use as structural support elements for thin brick and tile drainage system 10. Drainage panel 14 is preferably connected to support structure 16, but sheet 12 can be directly connected to support structure 16. Drainage panel 14 is a standard commercially available drainage panel and can vary widely in structure and material. Fasteners for connecting sheets 12 or sheet 12 and drainage panel 14 to support structure 16 include nails, staples, screws and suitable adhesives can be utilized. A given sheet 12 can be connected to one or more drainage panels 14.

As shown in FIGS. 3 and 4, the second embodiment of the thin brick and tile drainage system 10 is an interconnected assembly of sheet 12 and drainage panel 14 that is attached to support structure 16 using fasteners as described above. This simplified construction process advantageously saves time by creating a single assembly that combines the placement and integration of two components.

Referring now to FIGS. 1, 2, 5A and 5B, when sheet 12 comes in contact with a liquid such as water in the form of moisture penetration, water intrusion or condensation for example, that water is provided defined avenues of direction downward from sheet 12 as shown by exemplary axes A, B, C and D. The flat surfaces of walls 37, 39 and 41, the slope of surfaces 36, 38, 40 and 42 and apertures 44, 46 and 48 cooperatively assist in the drainage of water from front 18 to back 20. The angled and perforated structure of sheet 12 denies water the opportunity to pool or accumulate. In addition, water can also be provided additional avenues downward through and/or on drainage panel 14. Sheet 12 alone or in conjunction with drainage panel 14 directs water from front to back and downward for the controlled drainage of the overall structure. As an example, the downward traveling water on wall 41 passes onto portion 38*a* and, if so aligned for example, passes into aperture 44. The water then travels downward onto the adjoining at least liquid impermeable wall portion 38*b* and down the inclined back of portion 38*b* to back 20 of sheet 12. Once the water is in on back 20 of sheet 12 it continues downwards due to gravity for collection and drainage. Alternatively, the downward movement of the water can also include travel along or through drainage panel 14. The spacing of apertures 44, 46 and 48 on partitions 38, 36 and 40, respectively, increases the ability of sheet 12 to collect water on front 18 and redirect that water to the back of sheet 12.

The water that drains down front 18 of sheet 12 that is not collected by aperture 44, for example, passes down to wall 39 and/or partition 36 and through apertures 46 and is redirected by portion 36*b* to the back of sheet 12. Alternatively, draining water that is missed by apertures 44 and 46 is received into and redirected by the increased number of apertures 48 on partition 40. When sheet 12 is connected with other sheets 12 and partition 42 is positioned between portions 40*a* and 40*b*, partition 42 can be positioned and inclined to provide a redirection of drainage or liquid to back 20. It is the intended function of apertures 44, 46 and 48 to redirect the water or other liquid from front 18 of sheet 12 to back 20 and/or drainage panel 14 when present.

Sheets 12 remove potential barriers to the downwardly directed travel of water and eliminate areas that can accumulate water due to the angle of partitions 36, 38, 40 and 42 and walls 37, 39 and 41. This arrangement of apertures 44, 46 and 48 advantageously redirects water from diverse paths of fluid flow on front 18 through apertures 44, 46 and 48 to the back 20 of sheet 12. The water from sheets 12 is collected and drained at the base of the structure. Further, sheet 12 has a structure that reduces the likelihood of the undesirable growth of mold and mildew through the use of sloped surfaces that preclude the pooling of liquids and apertures that advantageously provide a plurality of paths for air to circulate through sheet 12.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. In addition, though the present invention is described in terms of a series of embodiments, each embodiment of the present invention can combine one or more novel features of the other embodiments. The specification and drawings are accordingly to be regarded in an illustrative manner rather than a restrictive sense.

What is claimed is:

1. A structure for the support and drainage of a thin brick façade that comprises:

a sheet that has a front face and an opposed back, a first lateral side edge and an opposed second lateral side edge, a longitudinal top edge and a longitudinally bottom edge, the front defines a plurality of longitudinally aligned channels, the channels defined by a pair of approximately parallel longitudinally aligned partitions, the pair of partitions separated by a wall of the front face, the partitions project forward from the front face, the channel adapted to receive and support thin bricks, a first partitions that defines an approximately V-shape comprising of an upward facing, first portion that defines a first plurality of apertures, each aperture of the first plurality of apertures defines a first alignment perpendicular to the longitudinal alignment of the partition, a second partition that defines an approximately V-shape comprising of an upward facing, first portion that defines a second plurality of apertures, each aperture of the second plurality of apertures defines a second alignment perpendicular to the longitudinal alignment of the second partition that is offset from the first alignment, each plurality of apertures positioned and aligned to redirect liquid received on the front of the sheet to the back of the sheet.

2. The structure of claim 1, wherein the sheet includes three channels that are adapted to receive thin bricks, a third longitudinally aligned partition that has an approximately V-shape that includes a third plurality of apertures, the third plurality of apertures greater in number than the first plurality of apertures and the third plurality of apertures greater in number than the second plurality of apertures, the third partition includes a first portion that connects to a second portion, the first portion inclines downward from the front face and defines the third plurality of apertures, the second portion inclines downward and is a liquid impermeable barrier.

3. The structure of claim 1, wherein at least two of the partitions includes the first portion that connects to a second portion, the first portion inclines downward from the front face and defines the plurality of apertures, the second portion inclines downward from the connection with the first portion.

4. The structure of claim 3, wherein the second portion of the at least two partitions is a liquid impermeable barrier that directs the flow of liquid from the front that is received through each of the plurality of apertures in the first portion to the back of the sheet.

5. The structure of claim 1, wherein the at least one of the plurality of apertures defined in the partitions extends at least partially onto the wall.

6. The structure of claim 1, wherein the plurality of apertures are arranged to provide a plurality of paths for air to circulate through the sheet.

7. The structure of claim 1, wherein an interconnected sheet and drainage panel form an integrated assembly.

8. The structure of claim 2, wherein the third plurality of apertures have a third alignment aligned perpendicular to the channel, the third alignment offset from at least one of the first plurality of apertures and the second plurality of apertures.

9. The structure of claim 2, wherein the third plurality of apertures have a third alignment aligned perpendicular to the channel, the third alignment offset from the first alignment and the second alignment.

10. A thin brick drainage system that comprises:

a sheet that has a front and an opposed back, a first lateral side edge and an opposed second lateral side edge, a top longitudinal edge and an opposed bottom longitudinal edge, the front defines a plurality of partitions that separate at least one longitudinally aligned channel, the partitions project outward from the front to define a support structure, the channel adapted to receive and support a row of thin bricks;

a first portion of the partition that is upward facing and projects forward from the front, the first portion of at least one of the partitions connects to a second portion of the partition that is downward facing and projects backward from the connection with the first portion at an incline from a perpendicular to the front, the connection of the first portion and second portion defines an edge and a gap is defined between the first portion and second portion that increases from the edge to the front; and a first partition that includes at least one aperture defined in the first portion of the first partition, the at least one aperture in the first partition defines a first vertical axis perpendicular to the channel;

a second partition that includes at least one aperture defined in the first portion of the second partition, the at least one aperture defines a second vertical axis perpendicular to the channel that is offset from the first vertical axis;

a third partition that includes at least one aperture defined in the first portion of the third partition, the at least one apertures of the partitions arranged to collect and redirect water from the front of the sheet to the back of the sheet.

11. The thin brick drainage system of claim 10, wherein the sheet includes three channels.

12. The thin brick drainage system of claim 11, wherein the three channels are defined by a first connector, a bottom partition and two partitions equally spaced between the first connector and the bottom partition.

13. The thin brick drainage system of claim 12, wherein the first portions of the partitions are inclined downward.

14. The thin brick drainage system of claim 10, wherein at least one sheet is connected to a drainage panel to form an interconnected sheet and drainage panel assembly.

15. The thin brick drainage system of claim 10, wherein the at least one aperture of the third partition defines a third axis aligned perpendicular to the channel, the third axis offset from the first axis and the third axis offset from the second axis.

16. The thin brick drainage system of claim 10, wherein the at least one aperture of the third partition defines a third axis aligned perpendicular to the channel, the third axis offset from the alignment of at least one of the first axis and the second axis.

17. A method for draining a structure that supports thin bricks comprising:

providing a sheet that has a front and a back, the front includes a plurality of longitudinally aligned partitions that extend outwardly from the front to define at least one longitudinally aligned channel, the channel adapted for receiving bricks; and draining fluids from the front of the sheet through a plurality of apertures defined in at least two of the partitions for the passage of fluids, the at least two partitions include a first portion of the partition that is upward facing and projects forward from the front in a downward slope to an edge, the first portion of the at least two partitions includes the plurality of apertures and connects to a second portion of the partition at the edge, the second portion inclined downward from the edge to the front for redirecting the fluids passing through the plurality of apertures to the back of the sheet, the plurality of apertures being at least partially offset in alignment and arranged to collect water.

18. The method as claimed in claim 17 further providing a sheet connected to a drainage panel, the interconnected sheet and drainage panel assembly draining fluids from the front of the sheet to the back of the sheet.

19. The method as claimed in claim 18, wherein the plurality of apertures provide a passageway for the circulation of air.

* * * * *